United States Patent [19]

Tesch

[11] Patent Number: 4,911,980

[45] Date of Patent: Mar. 27, 1990

[54] SPHERICAL FIBER AGGREGATE, IN PARTICULAR AS A FILLER OR CUSHIONING MATERIAL

[76] Inventor: Günter Tesch, Avenue Jean-Marie-Musy 15, CH-1700 Fribourg, Switzerland

[21] Appl. No.: 143,029

[22] Filed: Jan. 12, 1988

[30] Foreign Application Priority Data

Jan. 12, 1987 [DE] Fed. Rep. of Germany ..... 3700681

[51] Int. Cl.[4] ..... D02G 3/00

[52] U.S. Cl. ..... 428/357; 428/222; 428/227; 428/288; 428/296; 428/360; 428/362; 428/369; 428/370; 428/397; 428/400; 428/402

[58] Field of Search ..... 428/222, 227, 229, 292, 428/296, 357, 360, 359, 402, 369, 371, 288, 362, 370, 397, 400

[56] References Cited

U.S. PATENT DOCUMENTS

| | | | |
|---|---|---|---|
| 3,892,909 | 7/1975 | Miller | 428/371 |
| 4,065,599 | 12/1977 | Nishiumi et al. | 428/402 |
| 4,100,009 | 7/1978 | Nakajima et al. | 428/296 X |
| 4,131,704 | 12/1978 | Erickson | 428/296 |
| 4,413,030 | 11/1983 | Tesch et al. | 428/85 |
| 4,481,247 | 11/1984 | Tesch et al. | 428/234 |
| 4,618,531 | 10/1986 | Marcus | 428/283 |
| 4,783,364 | 11/1988 | Ilan | 428/369 |

*Primary Examiner*—Lorraine T. Kendell
*Attorney, Agent, or Firm*—Bacon & Thomas

[57] ABSTRACT

A spherical fiber aggregate, in particular as a filler and cushioning material of spherically entangled fibers and/or filaments, is described. In order to provide fiber balls of this generic type, having improved properties specifically for use as a filler material, it is proposed that the fiber balls contain a mixture of principal fibers and binder fibers. The binder fibers are connected with the principal fibers at their intersections.

According to one embodiment, the binder fibers are two-component fibers, wherein one of the components has in particular a strong bearing modulus and preferably only one component has a binder effect.

Due to the binder fibers, a three-dimensionally bonded network of all of the fibers is present in the fiber balls.

9 Claims, No Drawings

SPHERICAL FIBER AGGREGATE, IN PARTICULAR AS A FILLER OR CUSHIONING MATERIAL

The invention relates to a spherical fiber aggregate, in particular as a filler and cushioning material of fibers and/or filaments, which are spherically entangled.

From EP-A No. 0 203 469, fiber balls are known, which may be used as filler and cushioning materials. These fiber balls consist of helically curled polyester fibers entangled with each other, with a length of about 10 to 60 mm and a diameter between 1 and 15 mm. The fiber balls possess a certain elasticity, whereby the balls essentially recover after compression, even after a longer period of time (degree of recovery 80%). The fiber balls have a mutual cohesion of less than 6 Newton, preferably less than 4.5 Newton (according to a measuring method described therein).

Due to these low cohesion values, the fiber balls shift very easily within a filling, particularly when this filling is used in a pillow. If the sleeping person is resting with his head in the center of a pillow filled with such fiber balls, the pillow is pressured through very easily. To prevent this from happening, the fiber balls must have a relatively high density and consequently the pillows themselves become rather heavy. The pillows lose their "softness," which is found to be unpleasant by many.

From EP-A No. 0 013 427, spherical fiber aggregates are known in which fibers are wound into fiber balls. These fiber balls have a diameter of at least 3 mm. The balls may have diameters of up to 50 mm. The fibers used therein have lengths of at least 15 mm, preferably between 40 and 120 mm. The fiber balls have densities of between 0.01 and 0.1 g/cm$^3$. The fibers of the balls may be cotton or wool fibers, animal hairs or the like, or synthetic fibers, for example, polyamide, polyester, polypropylene fibers or the like, or a mixture thereof. In particular, the fibers may be curled fibers, for example curled synthetic fibers. Fiber balls of this type were used heretofore essentially for flat textile materials, in particular for the manufacture of carpets, clothing materials sleeping blankets, decorative materials or textile coverings. The fiber balls described in EP-A No. 0 013 are suitable as filler materials if they contain binders to prevent the disintegration of individual balls into the individual fibers.

It is the object of the present invention to provide fiber balls of the aforementioned generic type, having improved properties for their use as filler materials.

This object is attained by the present invention. The fiber balls according to the invention contain a mixture of principal fibers and binder fibers. If said binder fibers are distributed over the principal fibers, they are capable of bonding the principal fibers.

In order to obtain an appropriate distribution of the binder fibers within the fiber balls, the binder fibers have an elasticity different from that of the principal fibers. In the preparation (balling) of the fiber balls, the different elasticity of the fibers is utilized to assure that the different types of fibers in particular cross each other. Bonds between the two types of fibers may then be established at the intersections.

According to one embodiment of the invention, the binder fibers have a lesser modulus than the principal fibers.

The binder fibers preferably are two-compartment fibers, with one of the components in particular having an especially strong bearing modular compared to the other. It is then sufficient for one component to have a binding effect.

The binder fibers may be in the form of clad core fibers, preferably with the high modulus component on the inside and the binder component on the outside. However, the binder fibers may also be side-by-side fibers, wherein the binder component has a semicircular or quarter-moon shaped cross section.

The binder fibers preferably are coarser and/or more rigid than the principal fibers.

According to one embodiment, the binder fibers are significantly longer than the principal fibers and in particular have a length of 60 to 90 mm. In this case, they are also entangled within the fiber ball.

According to a further embodiment, the binder fibers are significantly shorter than the principal fibers and in particular are of a length which approximately corresponds to the diameter of the fiber ball. The binder fibers then are arranged in an approximately diametrical manner within the fiber ball. The binder fibers may protrude barb-like from the fiber ball.

According to a preferred embodiment, the binder fibers consist of the two components of polyethylene and polypropylene, with the components occupying an approximately semicircular cross section in the binder fibers. The binder fibers may have approximately the same length and thickness as the principal fibers. Such fiber balls surprisingly have a very high elasticity, which is substantially greater than that of the known fiber balls. It appears that a three-dimensionally bonded network of all the fibers is present in a fiber ball.

It is possible by means of the invention to provide fiber balls which may be looser and larger, without losing their elasticity. A very strong supporting effect is thereby obtained in a filling, in particular in the filling of a pillow, in the case of the latter for the head.

The fiber balls may be prepared by the process described in EP-A No. 0 203 469 or EP-A No. 0 013 427. After the formation of the spheres, the individual balls are transported to a source of heat, whereby the binder fibers are melted on their surface and a fiber-to-fiber connection is established at the intersections, in particular with the principal fibers.

I claim:

1. A spherical fiber aggregate for a filter or cushioning material, comprising fibers or filaments, which are spherically entangled and essentially form a ball of fibers, wherein the ball of fibers comprises a mixture of intersecting principal and binder fibers and wherein the binder fibers are joined to the principal fibers at the intersections; and wherein the binder fibers have an elasticity different from that of the principal fibers and a length corresponding approximately to the diameter of the fiber gall, and wherein the binder fibers are arranged in approximately diametrical manner within the fiber ball.

2. A spherical fiber aggregate according to claim 1, characterized in that the binder fibers have a lower modulus than the principal fibers.

3. A spherical fiber aggregate according to claim 1, characterized in that the binder fibers are coarser or more rigid than the principal fibers.

4. A spherical aggregate according to claim 1, characterized in that the binder fibers are two-component fibers comprising polyethylene and polypropylene, wherein one of the components has a particularly strong bearing modulus relative to the other component, which component is performing a binding action.

5. A spherical fiber aggregate according to claim 4, characterized in that the binding fibers are cladded core fibers, wherein the high modulus component is on the inside and the binding component is on the outside.

6. A spherical fiber aggregate according to claim 4, characterized in that the binder fibers are in the form of side-by-side fibers, with the binding component possessing a semicircular or a quarter-moon shaped cross section.

7. A spherical fiber aggregate according to claim 15, characterized in that the binder fibers protrude barb-like from the fiber ball.

8. A spherical fiber aggregate according to claim 1, characterized in that a three-dimensionally bonded network of all of the fibers is present in the fiber ball.

9. A spherical fiber aggregate for a filler or cushioning material, comprising fibers or filaments, which are spherically entangled and essentially form a ball of fibers wherein the ball of fibers comprises a mixture of intersecting principal fibers and binder fibers, the binder fibers comprising two components, polyethylene and polypropylene, with both components occupying approximately a semicircular cross section in the binder fibers and the binder fibers being joined to the principal fibers at the intersections.

* * * * *